US006437813B1

(12) United States Patent
Nishimura

(10) Patent No.: US 6,437,813 B1
(45) Date of Patent: Aug. 20, 2002

(54) THERMAL PRINTER

(75) Inventor: Tomoyoshi Nishimura, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/043,090

(22) Filed: Jan. 14, 2002

(30) Foreign Application Priority Data

Jan. 15, 2001 (JP) ..... 2001-006829

(51) Int. Cl.[7] ..... B41J 2/32
(52) U.S. Cl. ..... 347/175
(58) Field of Search ..... 347/172, 173, 347/175, 200; 400/120.02, 120.03

(56) References Cited

U.S. PATENT DOCUMENTS 6,297,840 B1 * 10/2001 Inana ..... 347/175
6,339,443 B1 * 1/2002 Nakanishi et al. ..... 347/200
2002/0021350 A1 * 2/2002 Nishimura ..... 347/218

FOREIGN PATENT DOCUMENTS

JP 11-78090 * 3/1999 ..... B41J/2/32
JP 2000-71495 * 3/2000 ..... B41J/2/32

* cited by examiner

*Primary Examiner*—Huan Tran
(74) *Attorney, Agent, or Firm*—Sughrue Mion, PLLC

(57) ABSTRACT

A yellow thermal head, a mazenta thermal head and a cyan thermal head are disposed along a feed path of the thermosensitive recording sheet at a predetermined distance. Each thermal heads confront to respective platen rollers. During feeding the thermosensitive recording sheet, a yellow image, a mazenta image and a cyan image are sequentially recorded. There is a difference in relative positions of the thermal heads to centers of the confronting platen rollers. An offset length has different values corresponding to coloring layers of the thermosensitive recording sheet. There is also a difference in withdraw angles at which the thermosensitive recording sheet leaves from the thermal heads. Each withdraw angle is determined corresponding to the thermal heads.

9 Claims, 3 Drawing Sheets

THERMAL PRINTER

BACKGROUND OF THE INVENTION

1. Field of the Invention

The present invention relates to a thermal printer for printing a full-color image on a thermosensitive color recording material in which a plurality of coloring layers is formed, while the thermosensitive recording sheet is fed once in a direction.

2. Description Related to the Prior Art

In a color thermal printer, a full-color image is printed on a color thermosensitive recording sheet having at least three thermosensitive coloring layers. Thereby a thermal head heats the thermosensitive recording sheet to make coloring while the color thermosensitive recording sheet is shifted relatively to the thermal head. There is formed on a support a type of the color thermosensitive recording sheet having a cyan, a mazenta and a yellow coloring layers as the thermosensitive coloring layers. These three coloring layers have different thermosensitivities such that the coloring of them may be selectively made. The yellow coloring layer is disposed uppermost and has the largest thermosensitivity, and the cyan coloring layer is disposed at the lowest position on the support and has the smallest thermosensitivity. After recording a monochromatic image in one of the coloring layers, fixing of color is carried out such that a ultra-violet ray is illuminated on the one coloring layer in order to prevent the recorded coloring layer from coloring again when next coloring layer is recorded.

As the thermal printer, one head-three pass type and three heads-one pass type are well known. In the one head-three pass type, the thermosensitive recording sheet is fed back and forth three times, and thereby yellow, mazenta and cyan images are sequentially recorded in the respective coloring layers. In the three heads-one pass type, a yellow thermal head, a mazenta thermal head and a cyan thermal head are arranged along a feed path of the thermosensitive recording sheet. Further, two lamps are respectively disposed between the yellow and mazenta coloring thermal heads and between the mazenta and cyan coloring thermal heads to illuminate a ultra-violet ray on the thermosensitive recording sheet.

During feeding the thermosensitive recording sheet in the feeding direction, the yellow thermal head records the yellow image in the yellow coloring layer. Thereafter, an ultra-violet ray is illuminated on the thermosensitive recording sheet to carry out the fixing of the yellow image. Then the mazenta thermal head records the mazenta image in the mazenta coloring layer with a higher thermal energy than the yellow thermal head. Thereafter, an ultraviolet ray is illuminated on the thermosensitive recording sheet to carry out the fixing of the mazenta image. Finally, the cyan thermal head records the cyan image in the cyan coloring layer with the highest thermal energy. As described above, the recording of the yellow, mazenta and cyan monochromatic images and the fixing of color are sequentially carried out to form a full-color image.

However, in the three heads-one pass type of the thermal printer, all of the thermal heads have a same head touching conditions, such as offset length between the thermal head and the platen roller, and a withdraw angle at which the thermosensitive recording sheet is inclined for leaving from the thermal head, are same. Accordingly, there is a difference in the graininess between the monochromatic images recorded in the respective coloring layers. Further, there may be sometimes unevenness in glossy surface while a lubricant agent and the like are issued out of the thermosensitive recording sheet and are adhered through the thermal head on the thermosensitive recording sheet again. Thus, the quality of a print becomes lower.

SUMMARY OF THE INVENTION

A main object of the present invention is to provide a thermal printer for printing a full-color image of a good quality.

Another object of the present invention is to provide a thermal printer in which a lubricant agent does not adhered on a color thermosensitive recording material such that there may be no unevenness in glossy surface.

Still another object of the present invention is to provide a thermal printer with which each monochromatic image is recorded with an adequate graininess.

In order to achieve the above objects, in the thermal printer of the present invention, relative positions of the thermal heads to the confronting platen rollers along a feed direction are different corresponding to the respective thermosensitive coloring layers to be recorded. Namely, an offset length has different values corresponding to the thermal heads, while the offset length is defined as a length between an imaginary vertical line TCL passing a center of the heating elements and an imaginary vertical line PCL passing a rotational center of the platen roller.

When the TCL is in an upstream side of the feeding direction of the thermosensitive recording material from the PCL, the offset length has a positive sign, and when the TCL is in a downstream side of the feeding direction of the thermosensitive coloring material from the PCL, the offset length has a negative sign. When the uppermost layer, for example yellow thermosensitive coloring layer, is heated, the offset length is larger than when the lowest layer, for example a cyan coloring layer, is heated. In a preferable embodiment of the present invention, the offset length for the yellow thermosensitive coloring layer is +100 $\mu$m, and that for the cyan thermosensitive coloring layer is −100 $\mu$m.

Further, withdraw angles from the respective thermal heads are different corresponding to the thermosensitive coloring layers to be recorded. The withdraw angle is larger for recording in the cyan thermosensitive coloring layer than that in the yellow thermosensitive coloring layer.

According to the thermal printer of the present invention, monochromatic images are recorded in the respective recording layers to have the most adequate graininess. Further, a lubricant agent, even if it is issued out from a protective layer of the thermosensitive recording material, is not adhered through the thermal head to the thermosensitive recording material again. Therefore, there is no unevenness in glossy surface. The present invention achieves that the full-color image of high quality is printed on the thermosensitive recording material.

BRIEF DESCRIPTION OF THE DRAWINGS

The above objects and advantages of the present invention will become easily understood by one of ordinary skill in the art when the following detailed description would be read in connection with the accompanying drawings.

PREFERRED EMBODIMENTS OF THE INVENTION

Figure 1:
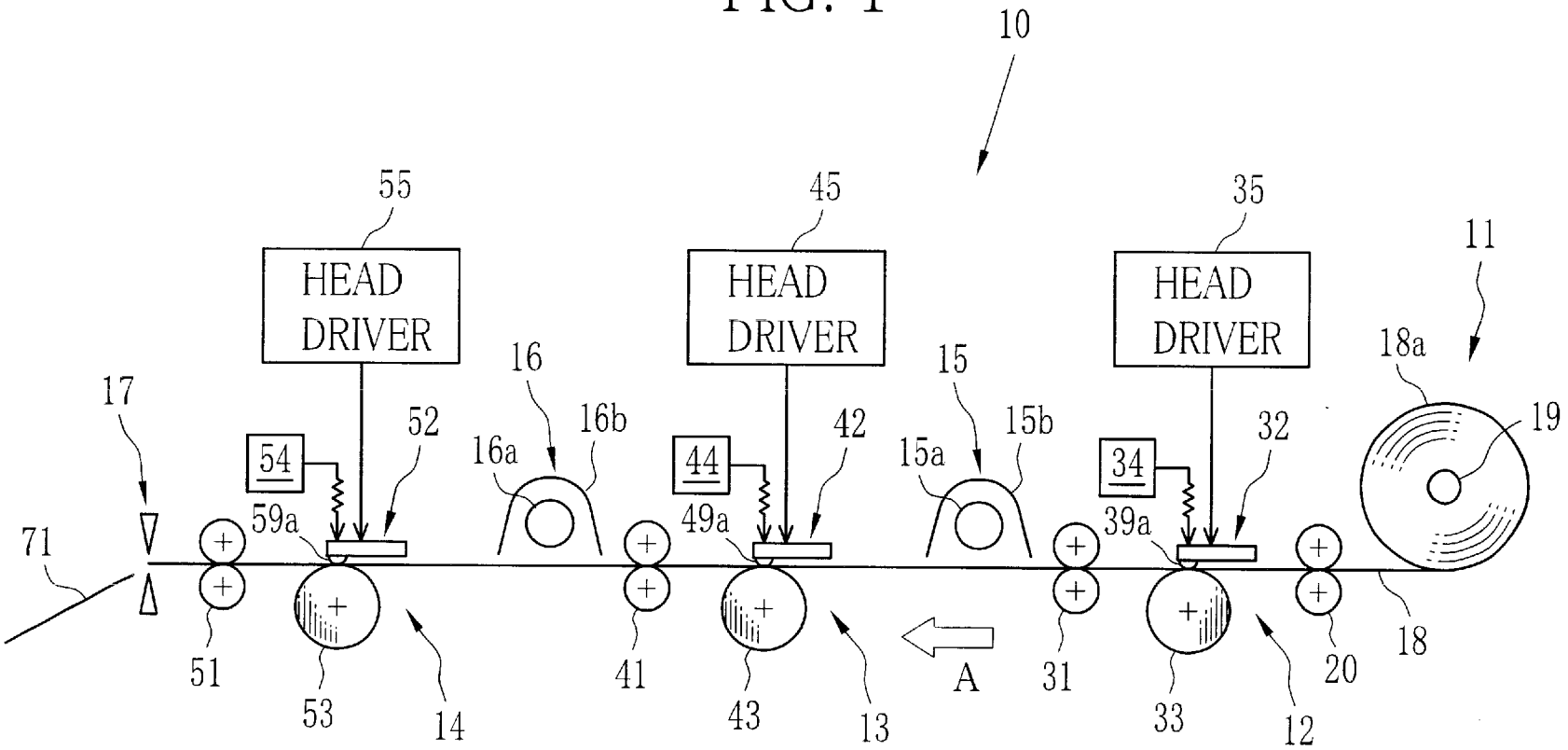
FIG. 1 is a schematic diagram of a color thermal printer.

In FIG. 1, a color thermal printer 10 is constructed of a sheet feeding section 11, a yellow image recording section 12, a mazenta image recording section 13, a cyan image recording section 14, a yellow fixer 15, a mazenta fixer 16 and a cutter 17. In the sheet feeding section 11, a shaft 19 rotatably supports a recording sheet roll 18*a* in which a color thermosensitive recording sheet 18 is rolled. The thermosensitive recording sheet 18 is pulled from the recording sheet roll 18*a* by a feed-roller pair 20 and fed in a feed direction A.

The yellow image recording section 12 is constituted of a feed-roller pair 31, a thermal head 32, a platen roller 33, a head pressing mechanism 34 and a head driver 35. The feed-roller pair 31 nips the thermosensitive recording sheet 18 and is rotated by a pulse motor (not shown). An upper roller of the feed-roller pair 31 is a pinch roller, and a lower roller thereof is a capstan roller. When an end of the thermosensitive recording sheet 18 reaches the feed-roller pair 31, the upper pinch roller is moved to the lower capstan roller to nip the thermosensitive recording sheet 18.

The thermal head 32 is disposed over a feed path of the thermosensitive recording sheet 18 and confronts to the platen roller 33 disposed below the feed path. The head pressing mechanism 34 moves the thermal head 32 so as to alternatively set it in a recording position and a retracted position. In the retracted position, a heating element array 39*a* is apart from the thermosensitive recording sheet 18. The head driver 35 heats each heating elements of the heating element array 39*a* according to data of a yellow image. Further, the pulse motor, the head pressing mechanism 34 and the head driver 35 are controlled by a controller (not shown). As the mazenta image recording section 13 and the cyan image recording section 14 has a same structure, they are not explained but numerals are applied to corresponding elements.

Figure 2:
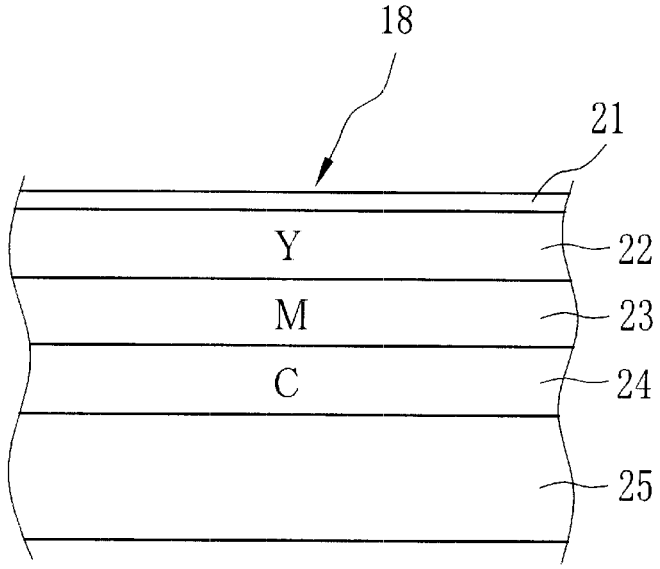
FIG. 2 is a sectional view of a thermosensitive recording sheet.

As shown in FIG. 2, a protective layer 21, a yellow coloring layer 22, a mazenta coloring layer 23 and a cyan coloring layer 24 are formed on a support 25 in the thermosensitive recording sheet 18. The protective layer 21 is a transparent resin layer and protects the coloring layers 22–24 against being harmed. A lubricant agent is applied to the protective layer 21 in order to prevent blocking (adhering). While the yellow coloring layer 22 is disposed at the top of the thermosensitive layers, it has the highest thermosensitivity, and a yellow image is recorded by heating with the lowest thermal energy. The mazenta coloring layer 23, as disposed between the yellow and cyan coloring layers, has the middle thermosensitivity and a mazenta image is recorded by heating with the higher thermal energy. While the cyan coloring layer 24 is disposed at the lowest of the thermosensitive layers, it has the lowest thermosensitivity, and a cyan image is recorded by heating with the highest thermal energy. Note that a positional relation of the thermosensitive coloring layers 22–24 may be changed, and the thermosensitive recording sheet may be further provided with for example a black coloring layer and have more than four thermosensitive coloring layers.

As shown in FIG. 1, the yellow fixer 15 consists of a lamp 15*a* and a reflector 15*b*. The lamp 15*a* illuminates an ultraviolet ray having a peak of the wavelength at the 420 nm to carry out the fixing of a recording area of the yellow coloring layer 22 in which the yellow image has been recorded. Further, the mazenta fixer 16 includes a lamp 16*a* and a reflector 16*b*. The lamp 16*a* illuminates an ultraviolet ray having a peak of the wavelength at 365 nm to carry out the fixing of a recording area of the mazenta coloring layer 23 in which the mazenta image has been recorded. Such illuminations in the yellow and mazenta fixers 15, 16 are controlled by a controller (not shown).

Figure 3:
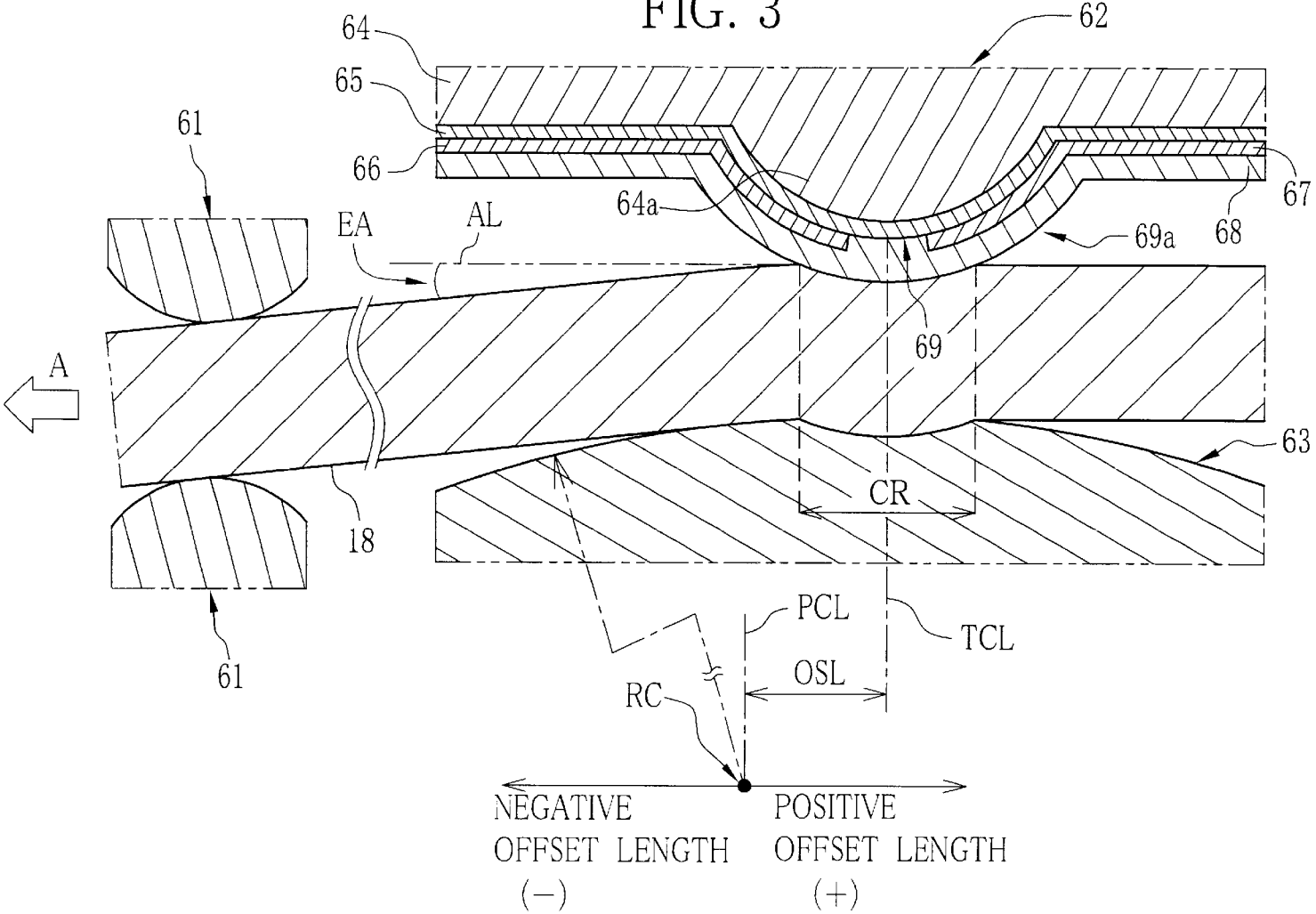
FIG. 3 is a sectional view of an image recording section of the color thermal printer of the present invention, illustrating a positional relation between a thermal head, a platen roller, the thermosensitive recording sheet and a feed-roller pair.

Every image recording sections 12–14 of the thermal printer of the present invention include a feed-roller pair, a thermal head, and a platen roller as common elements. In FIG. 3, they are illustrated, and numerals 61, 62, 63 are applied to them respectively. The thermal head 62 is constructed of an alumina board (not shown), a glaze layer 64, a partial glaze 64*a*, a heat resistance film 65, electrodes 66, 67 and a protective layer 68. The partial glaze 64*a* is protruded in a cylindrical shape.

Each of the electrodes 66, 67 extends in parallel. A part of the heat resistance film 65 between a pair of the electrodes 66, 67 constitutes heating elements 69. The heating elements 69 are arranged in a main scanning direction (or widthwise direction of the thermosensitive recording sheet) to construct a heating element array 69*a*. Thickness of the glaze layer 64 or the partial glaze 64*a* is determined in accordance with kinds of recording materials or recording speed.

The feed-roller pair 61 rotates to feed the thermosensitive recording sheet 18 in a sub-scanning direction A, and a head pressing mechanism (not shown) presses the thermal head 62 onto the platen roller 63 at a predetermined pressure such that the heating element array 69*a* may contact to the thermosensitive recording sheet 18 to form a contact region CR. The platen roller 63, as made of a rubber-like material, is slightly deformed, and the contact region CR becomes larger. Therefore, the contact of the heating element array 69*a* to the thermosensitive recording sheet 18 becomes more stable. Then, the heating elements 69 are respectively heated into temperatures in accordance with data of the monochromatic image to be recorded.

An imaginary vertical line TCL extended from a center of the heating elements 69, and another imaginary vertical line PCL extended from a rotational center RC of the platen roller 63. A distance between the vertical lines TCL and PCL is characterized as an offset length OSL. And the relation of the offset length OSL to the RMS granularity value was searched in the yellow, mazenta and cyan coloring layer, respectively. Note that the grainuiness becomes better if the RMS granularity value becomes smaller.

Figure 4:
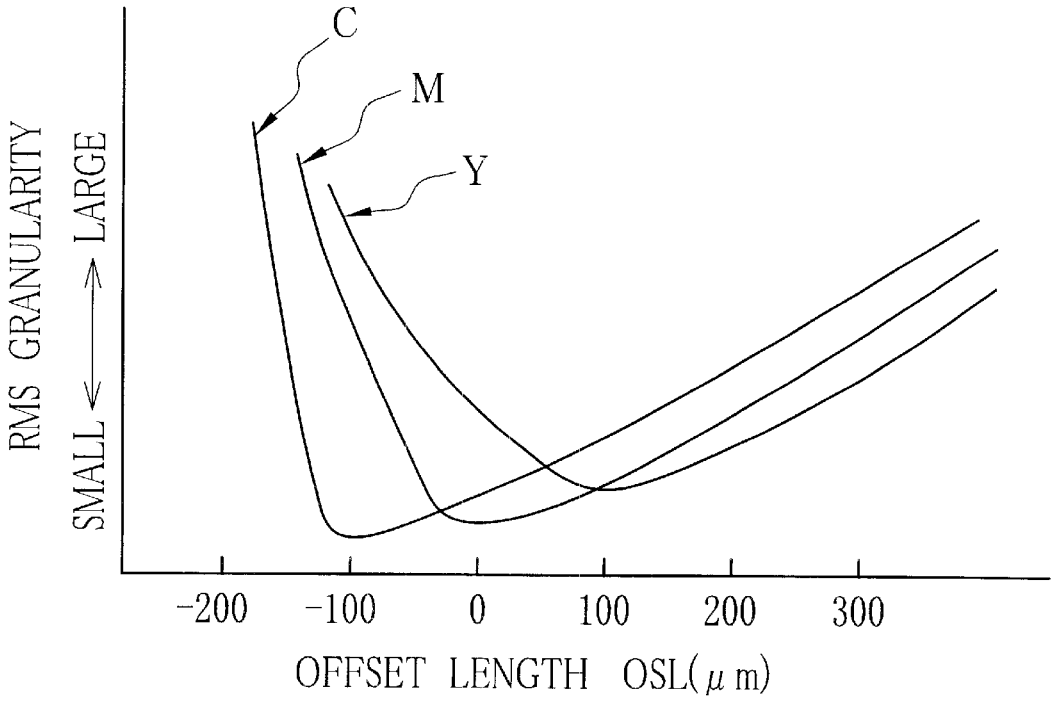
FIG. 4 is a graphic chart illustrating a relation between offset length and RMS granularity of cyan, mazenta, and yellow coloring layers.

In FIG. 4, a curve Y illustrates the relation of the offset length to the RMS granularity value in the yellow coloring layer 22, a curve M and a curve C illustrate those in the mazenta and cyan coloring layers 23, 24 respectively. When the imaginary vertical line TCL is positioned in an upstream side of the feed direction A from the imaginary vertical line PCL, the offset length is positive. When the imaginary vertical line TCL is positioned in a downstream side of the feed direction A from the imaginary vertical line PCL, the offset length is negative.

As shown in FIG. 4, the RMS granularity value depends on the offset length in each coloring layer. The adequate offset length is +100 $\mu$m in the yellow coloring layer 22, 0 $\mu$m in the mazenta coloring layer 23, and −100 $\mu$m in the cyan coloring layer 24. Accordingly, in yellow, mazenta and cyan image recording sections 12, 13, 14, the thermal heads 32, 42 and 52 are disposed such that the offset length OSL may be set in the above described values. Note that the offset length is not restricted in the above values, and determined in accordance with the recording medium and the recording speed. However, the offset length becomes larger in the upper-disposed coloring layer.

Further, in FIG. 3, a tension of the feed-roller pair 61 to feed the thermosensitive recording sheet 18 varies, which causes the thermosensitive recording sheet 18 to unstably contact to the heating element 69. Accordingly, the variation of the tension has a larger influence on forming the monochromatic image in upper one of the three coloring layers. In order to stably contact the thermosensitive recording sheet 18 to the heating element 69, the thermosensitive recording sheet 18 should be fed parallel to the thermal head 62.

However, when the cyan image is recorded in the lowest cyan coloring layer of the three, a lubricant agent can be more often issued out from the protective layer 21 as a high thermal energy is provided. If a withdraw angle EA from the thermal head 62 is small, a space between the thermosensitive recording layer 18 and the thermal head 62 is small and the issued lubricant agent easily adheres on a surface of the thermosensitive recording layer, which causes unevenness in glossy surface of the thermosensitive coloring layer 18. Accordingly, the withdraw angle EA should be larger to keep the space between the thermosensitive recording sheet 18 and the thermal head 62 when the monochromatic image is formed in lower one of the three coloring layers.

In this embodiment, the feed-roller pairs 31, 41, 51 are disposed such that the withdraw angle may be set at 0° in the yellow image recording section 12, at 2° in the mazenta image recording section 13, and at 6° in the cyan image recording section 14. Thus, the thermosensitive recording sheet 18 stably contacts to the thermal head 32 in the yellow image recording section 12. In the cyan image recording section 14, the space between the thermal head 52 and the thermosensitive recording sheet 18 is enough that the issued lubricant agent may not adhere to the thermosensitive recording sheet 18 and there may be no unevenness in glossy surface. Note that the value of the withdraw angle EA is not restricted in above, and the withdraw angle EA is changed in accordance with a recording material and a recording speed.

The operation of the above structure will be explained now. When a print key of the thermal printer 10 is operated to start printing, a controller causes the lamps 15*a* and 16*a* to illuminate and drives the pulse motor to rotate the feed-roller pair 20. Then, the thermosensitive recording sheet 18 is pulled from the recording sheet roll 18*a* and fed in the feed direction A through a space between the thermal head 32 in the retracted position and the platen roller 33.

During feeding the thermosensitive recording sheet 18, pulses provided for the pulse motor are counted. When it is detected from the number of the counted pulses that a leading end of the thermosensitive recording sheet 18 reaches the feed-roller pair 31, the controller stops the pulse motor. After the thermosensitive recording sheet 18 is stopped, the thermal head 32 is set in the recording position by the head pressing mechanism 34.

The controller drives the head driver 35 to heat the heating elements 39 in accordance with data of the yellow image. As the offset length between the thermal head 32 and the platen roller 33 is set at +100 $\mu$m, a line of the yellow image is recorded with the best graininess in the yellow coloring layer 22.

After finishing the recording of a line of the yellow image, the pulse motor is rotated for predetermined steps to feed the thermosensitive recording sheet 18 for a length corresponding to the line. As the withdraw angle EA is set at 0°, the thermosensitive recording sheet 18 stably contacts to the heating element array 39*a*. Until recording the yellow image is finished, recording and feeding of one line are sequentially repeated as described above. When the yellow image reaches the yellow fixer 15, the lamp 15*a* emits a ultra-violet ray to fix the yellow image in the yellow coloring layer 22.

After fixing the yellow image, the thermosensitive recording sheet 18 is fed to the feed-roller pair 41 through the space between the thermal head 42 in the retracted position and the platen roller 43. When the leading end of the thermosensitive recording sheet 18 reaches the feed-roller pair 41, the thermal head 42 is set in the recording position with the head pressing mechanism 44. The number of the pulses is counted also thereby, and position of the leading end is detected.

When the heating elements 49 contact to an end of the yellow image, the controller drives the head driver 45 to heat the heating elements 49 in accordance with data of the mazenta image so as to mazenta dot overlap with yellow dot. As the offset length between the thermal head 42 and the platen roller 43 is set at 0 $\mu$m, a line of the mazenta image is recorded with the best graininess in the mazenta coloring layer 23.

Thereafter, the thermosensitive recording sheet 18 is fed corresponding to the width of the array. As the withdraw angle EA is set at 2°, the thermosensitive recording sheet 18 stably contacts to the heating element array 49*a*. Until recording the mazenta image is finished, recording and feeding are repeated by one line. When the mazenta image reaches the mazenta fixer 16, the lamp 16*a* emits a ultra-violet ray to fix the mazenta image in the mazenta coloring layer 23.

After fixing the mazenta image, the thermosensitive recording sheet 18 is fed to the feed-roller pair 51 through the space between the thermal head 52 in the retracted position and the platen roller 53. When the leading end of the thermosensitive recording sheet 18 reaches the feed-roller pair 51, the thermal head 52 is set in the recording position with the head pressing mechanism 54.

When the heating elements 59 contact to an end of the yellow and mazenta image, the controller drives the head driver 55 to heat the heating elements 59 in accordance with data of the cyan image. As the offset length between the thermal head 52 and the platen roller 53 is set at −100 $\mu$m, a line of the cyan image is recorded with the best graininess in the cyan coloring layer 24.

During recording the cyan image, as the withdraw angle EA is set at 6°, the space between the thermosensitive recording sheet 18 and the thermal head 52 is enough to prevent the issued lubricant agent from adhering to the surface of the thermosensitive recording sheet 18, and the surface does not become uneven. Until recording the cyan image is finished, recording and feeding are sequentially repeated by one line. The monochromatic images are recorded in the respective coloring layers 22–24, and full color picture frames are constituted. On the continuous thermosensitive recording sheet 18, the full color picture frames are formed at a predetermined pitch. And they are cut into each color prints 71 by the cutter 17.

In the above embodiment, both of the center of the heating element and the top of the glaze layer lie on the same imaginary line TCL. The heating elements may be also disposed in another position on the glaze layer for changing the offset length. In this case, the top of the glaze layer and the center of the platen roller lie on the imaginary vertical line PCL.

Various changes and modifications are possible in the present invention and may be understood to be within the present invention.

What is claimed is:

1. A thermal printer for printing a full-color image on a thermosensitive recording material in which at least first, second, and third thermosensitive coloring layers are formed, said first thermosensitive coloring layer being an uppermost layer, and said third thermosensitive coloring layer being the lowest layer, said thermal printer comprising:

first, second and third thermal heads disposed along a feed path of said thermosensitive recording material one by one from an upstream side, said first thermal head recording in said first thermosensitive coloring layer, said second thermal head recording in said second thermosensitive coloring layer, and said third thermal head recording in said third thermosensitive coloring layer;

first, second and third platen rollers confronting said first, second and third thermal heads respectively, each of said platen rollers pressing said thermosensitive recording material on heating elements arranged on the confronting one of said thermal heads; and an offset length being set in accordance with said thermosensitive coloring layer to be recorded, wherein said offset length is a distance between an imaginary vertical line from a center of said heating element and an imaginary vertical line from a center of said platen roller.

2. A thermal printer described in claim 1, wherein a following formula is satisfied:

$$OSL_3<OSL_2<OSL_1$$

wherein

OSL: said offset length, said offset length being positive when TCL is in said upstream side from PCL, and negative when TCL is in a downstream side from PCL, $OSL_1$: OSL of said first thermal head, $OSL_2$: OSL of said second thermal head, $OSL_3$: OSL of said third thermal head.

3. A thermal printer described in claim 2, wherein said first thermosensitive coloring layer colors in yellow, said second thermosensitive coloring layer colors in mazenta, and said third thermosensitive coloring layer colors in cyan.

4. A thermal printer described in claim 3, wherein said $OSL_1$ is +100 $\mu$m, said $OSL_2$ is 0 $\mu$m, and said $OSL_3$ is −100 $\mu$m.

5. A thermal printer described in claim 4, wherein when leaving said thermal head, said thermosensitive coloring material is inclined to said platen roller at a withdraw angle corresponding to said thermosensitive coloring layer to be printed.

6. A thermal printer described in claim 5, further comprising first, second and third feed roller pairs disposed downstream from said first, second and third thermal head respectively, a position of said feed-roller pair being changed vertically in order to keep said withdraw angle.

7. A thermal printer described in claim 6, wherein a following formula is satisfied:

$$EA_1<EA_2<EA_3$$

wherein $EA_1$: said withdraw angle of said first thermal head, $EA_2$: said withdraw angle of said second thermal head, $EA_3$: said withdraw angle of said third thermal head.

8. A thermal printer described in claim 7, wherein said $EA_1$ is 0°, $EA_2$ is 2°, and $EA_3$ is 6°.

9. A thermal printer described in claim 7, wherein each of said heating elements has an arc shaped form, and said first, second and third platen rollers has elasticity.

* * * * *